US010179970B2

(12) United States Patent
Byrd et al.

(10) Patent No.: US 10,179,970 B2
(45) Date of Patent: Jan. 15, 2019

(54) PROCESS FOR DYEING FABRIC

(71) Applicant: Shaw Industries Group, Inc., Dalton, GA (US)

(72) Inventors: Mike Byrd, Cartersville, GA (US); Reesie Duncan, Cartersville, GA (US); Jason Fazi, Woodstock, GA (US)

(73) Assignee: Columbia Insurance Company, Omaha, NE (US)

( * ) Notice: Subject to any disclaimer, the term of this patent is extended or adjusted under 35 U.S.C. 154(b) by 168 days.

(21) Appl. No.: 13/839,857

(22) Filed: Mar. 15, 2013

(65) Prior Publication Data

US 2014/0259457 A1 Sep. 18, 2014

(51) Int. Cl.
*D06P 1/00* (2006.01)
*D06P 3/24* (2006.01)

(52) U.S. Cl.
CPC ..... *D06P 1/0096* (2013.01); *D06P 3/241* (2013.01)

(58) Field of Classification Search
CPC ..... D06P 1/0096; D06P 3/241
See application file for complete search history.

(56) References Cited

U.S. PATENT DOCUMENTS 3,918,111 A * 11/1975 Dunn ..... 8/149.1
4,053,668 A * 10/1977 Kimmel et al. ..... 428/95
4,697,291 A * 10/1987 Shepherd et al. ..... 8/151
5,360,455 A * 11/1994 Hannemann ..... B29C 59/10 8/115.52
5,846,265 A * 12/1998 McGregor et al. ..... 8/400
6,497,731 B1 * 12/2002 Berthelon ..... D06P 1/0032 8/442
2002/0002267 A1 * 1/2002 Long ..... 528/310
2003/0220037 A1 * 11/2003 Dewhurst et al. ..... 442/181

FOREIGN PATENT DOCUMENTS

CN 106728 A 12/1992
CN 2014100970239 3/2014

OTHER PUBLICATIONS

Office Action dated Apr. 25, 2017 by the State Intellectual Property Office of the People's Republic of China for Chinese Patent Application No. 201410097023.9, which was filed on Mar. 14, 2014 and published as 104047183 on Sep. 17, 2014 (Inventor—Byrd et al.; Applicant—Shaw Industries Group, Inc.;) (Original—7 pages/ Translation—7 pages).
Second Office Action dated Dec. 18, 2017 by the SIPO for CN Patent Application No. CN 201410097023, which was filed on Mar. 14, 2014 and published as CN 104047183 on Sep. 17, 2014 (Applicant—Shaw Industries Group, Inc.) (Original—3 pages// Translation—4 pages).

* cited by examiner

*Primary Examiner* — Amina S Khan
(74) *Attorney, Agent, or Firm* — Ballard Spahr LLP

(57) ABSTRACT

In one aspect, the invention relates to methods for dyeing greige goods to produce a random dye pattern, compositions and articles produced therefrom. In a further aspect, the invention relates to methods of methods for dyeing greige goods to produce a random dye pattern using a dyeing machine. In still a further aspect, the invention relates to methods of producing unique dye patterns for greige goods. This abstract is intended as a scanning tool for purposes of searching in the particular art and is not intended to be limiting of the present invention.

43 Claims, 4 Drawing Sheets

PROCESS FOR DYEING FABRIC

BACKGROUND OF THE INVENTION

Manufacturers have traditionally sought to produce carpet and carpet tiles to having uniform appearance constant color and shade. To achieve a single, consistent overall appearance, the dyeing process takes place under carefully controlled conditions to ensure that the dye is evenly distributed throughout the dyeing solution and carpet and is absorbed by the carpet uniformly to create a level, reproducible final product.

However, there continues to be a growing demand for unique carpet and carpet tile designs beyond uniform one, two, or three shade designs and patterns. Achieving patterned carpets is generally dependent on user provided designs and specialized machinery. As those of ordinary skill in the art will appreciate, these factors can make it expensive to produce even small lots of unique design.

Accordingly, there is a need for methods of dyeing fabrics, including carpet and carpet tiles, which produce unique patterns that are not restricted to a single, consistent overall appearance. Moreover, there also remains a need for methods of dyeing a fabric to produce distinct visual effects within a floor covering, thereby producing varying overall appearances and visual effects. These needs and other needs are met by the various aspects of the present disclosure.

SUMMARY OF THE INVENTION

In conventional dyeing methods, the dyeing process takes place under carefully controlled conditions to ensure that the dye is evenly distributed throughout the dyeing solution and carpet and is absorbed by the carpet uniformly to create a level, reproducible final product. For example, in conventional dyeing methods, the pH of the dye bath is dropped at a rate which causes the dye to slowly diffuse into the fiber matrix. In this aspect, conventional dyeing methods control pH such that the dye becomes evenly distributed throughout the dye bath and fibers and is absorbed by the fibers uniformly to create a constant color and shade.

However, it has been discovered that by initiating the dyeing process at a low pH and using the disclosed process, fabrics can be produced having unique dye patterns and designs. In further aspects, the present process also utilizes the effects of dye diffusion into the dye solution in conjunction with the rate of dye movement within the fiber matrix. In still further aspects, the random migration of the dye in the aqueous liquid dyeing bath can produce dye patterns having differing, random levels of dye depth of the dye color. Moreover, the unique dyeing patterns and designs produced by the disclosed dyeing process can be manufactured using conventional dyeing machines, and without the need for specialized machinery or design input.

In accordance with the purpose(s) of the invention, as embodied and broadly described herein, the invention, in one aspect, relates to processes for dyeing fabric and articles produced therefrom.

In another aspect, the invention relates to a process for dyeing a fabric, comprising the steps of: immersing at least a portion of a fabric comprised of dyeable fibrous material in an aqueous liquid dyeing bath; adjusting the aqueous liquid dyeing bath to an elevated temperature greater than room temperature and below a boiling point of the aqueous dyeing bath; adjusting the pH of the aqueous liquid dying bath to an acidic level less than 7.0; after immersing at least a portion of the fabric into the aqueous liquid dyeing bath, introducing an amount of anionic dye into the aqueous liquid dyeing bath at a dye addition rate for a dye addition period to provide a dye solution, wherein the aqueous liquid dyeing bath is maintained at the elevated temperature and at the acidic level of pH for the dye addition period; and contacting the dyeable fibrous material with the dye solution for a dyeing period sufficient to dye at least a portion of the dyeable fibrous material.

Also disclosed are the products and articles of the disclosed methods.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

BRIEF DESCRIPTION OF THE FIGURES

The accompanying figures, which are incorporated in and constitute a part of this specification, illustrate several aspects and together with the description serve to explain the principles of the invention.

Figure 1:
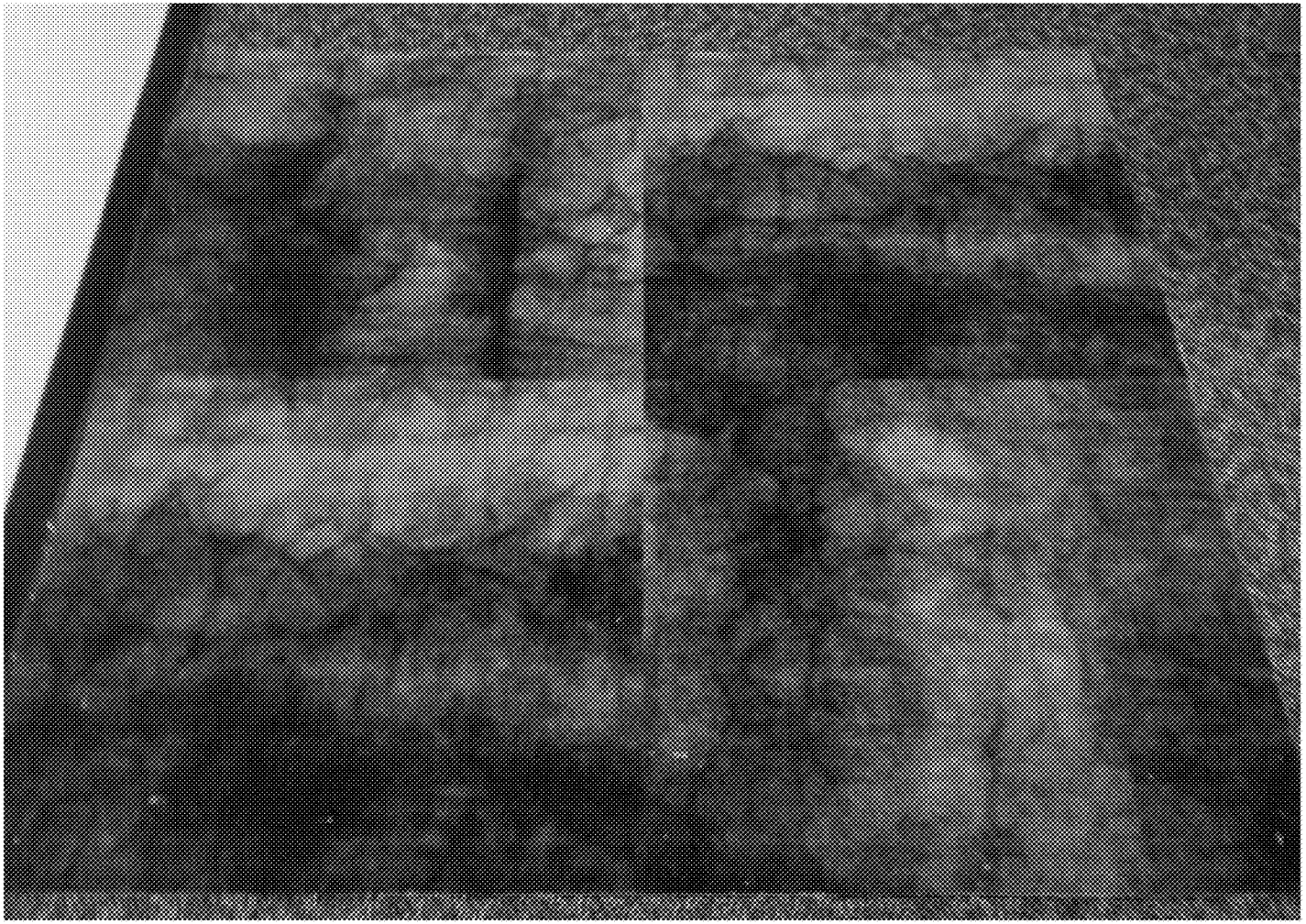
FIG. 1 is a picture of representative carpet tiles produced in accordance with methods of the present invention.

Additional advantages of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE INVENTION

The present invention can be understood more readily by reference to the following detailed description of the invention and the Examples included therein.

Before the present compounds, compositions, articles, systems, devices, and/or methods are disclosed and described, it is to be understood that they are not limited to specific synthetic methods unless otherwise specified, or to particular reagents unless otherwise specified, as such may, of course, vary. It is also to be understood that the terminology used herein is for the purpose of describing particular aspects only and is not intended to be limiting. Although any methods and materials similar or equivalent to those described herein can be used in the practice or testing of the present invention, example methods and materials are now described.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications are referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present invention is not entitled to antedate such publication by virtue of prior invention. Further, the dates of publication provided herein may be different from the actual publication dates, which can require independent confirmation.

A. Definitions

Although any methods and materials similar or equivalent to those described herein can be used in the practice or testing of the present invention, example methods and materials are now described.

As used in the specification and the appended claims, the singular forms "a," "an" and "the" include plural referents unless the context clearly dictates otherwise. Thus, for example, reference to "a composition," "a fiber," or "a step" includes mixtures of two or more such functional compositions, fibers, steps, and the like.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

References in the specification and concluding claims to parts by weight of a particular element or component in a composition denotes the weight relationship between the element or component and any other elements or components in the composition or article for which a part by weight is expressed. Thus, in a compound containing 2 parts by weight of component X and 5 parts by weight component Y, X and Y are present at a weight ratio of 2:5, and are present in such ratio regardless of whether additional components are contained in the compound.

A weight percent (wt. %) of a component, unless specifically stated to the contrary, is based on the total weight of the formulation or composition in which the component is included.

As used herein, the terms "optional" or "optionally" means that the subsequently described event or circumstance can or cannot occur, and that the description includes instances where said event or circumstance occurs and instances where it does not.

As used herein, the term "effective amount" refers to an amount that is sufficient to achieve the desired result or to have an effect on an undesired condition.

As used herein, the term "polymer" refers to a relatively high molecular weight organic compound, natural or synthetic, whose structure can be represented by a repeated small unit, the monomer (e.g., polyethylene, rubber, cellulose). Synthetic polymers are typically formed by addition or condensation polymerization of monomers. Homopolymers (i.e., a single repeating unit) and copolymers (i.e., more than one repeating unit) are two categories of polymers.

Certain materials, compounds, compositions, and components disclosed herein can be obtained commercially or readily synthesized using techniques generally known to those of skill in the art. For example, the starting materials and reagents used in preparing the disclosed compounds and compositions are either available from commercial suppliers such as Aldrich Chemical Co., (Milwaukee, Wis.), Acros Organics (Morris Plains, N.J.), Fisher Scientific (Pittsburgh, Pa.), or Sigma (St. Louis, Mo.) or are prepared by methods known to those skilled in the art following procedures set forth in references such as Fieser and Fieser's Reagents for Organic Synthesis, Volumes 1-17 (John Wiley and Sons, 1991); Rodd's Chemistry of Carbon Compounds, Volumes 1-5 and Supplementals (Elsevier Science Publishers, 1989); Organic Reactions, Volumes 1-40 (John Wiley and Sons, 1991); March's Advanced Organic Chemistry, (John Wiley and Sons, 4th Edition); and Larock's Comprehensive Organic Transformations (VCH Publishers Inc., 1989).

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of embodiments described in the specification.

In various aspects, the present invention is useful for any fabric comprised of dyeable fibrous material. In further aspects, the fabric is a greige good or carpet. In still further aspects, the invention pertains to any type or style of carpet or carpet tile. In yet further aspects, the present invention pertains to any carpet constructed with a primary backing material and includes tufted carpet and non-tufted carpet such as needle punched carpet. In yet further aspects, the present invention is amenable to tufted and non-tufted carpet, tufted carpet is preferred.

Tufted carpets are composite structures which include yarn (which is also known as a fiber bundle), a primary backing material having a face surface and a back surface, an adhesive backing material and, optionally, a secondary backing material. To form the face surface of tufted carpet, yarn is tufted through the primary backing material such that the longer length of each stitch extends through the face surface of the primary backing material. Typically, the primary backing material is made of a woven or non-woven material such as a thermoplastic polymer, most commonly polypropylene.

In various aspects, the face of a tufted carpet can generally be made in three ways. First, for loop pile carpet, the yarn loops formed in the tufting process are left intact. Second, for cut pile carpet, the yarn loops are cut, either during tufting or after, to produce a pile of single yarn ends instead of loops. Third, some carpet styles include both loop and cut pile. One variety of this hybrid is referred to as tip-sheared carpet where loops of differing lengths are tufted followed by shearing the carpet at a height so as to produce a mix of uncut, partially cut, and completely cut loops. Alternatively, the tufting machine can be configured so as to cut only some of the loops, thereby leaving a pattern of cut and uncut loops. Whether loop, cut, or a hybrid, the yarn on the back side of the primary backing material comprises tight, unextended loops.

In further aspects, the combination of tufted yarn and a primary backing material without the application of an adhesive backing material or secondary backing material is referred to in the carpet industry as raw tufted carpet or greige goods. In still further aspects. the raw carpet or greige good is dyed, and becomes finished tufted carpet with the application of an adhesive backing material and an optional secondary backing material to the back side of the primary backing material. Finished tufted carpet can be prepared as broad-loomed carpet in rolls typically 6 or 12 feet wide. Alternatively, carpet can be prepared as carpet tiles, typically 18 inches square in the United States and 50 cm. square elsewhere.

B. Process For Dyeing A Fabric

According to various aspects of the disclosure, the invention relates to a process for dyeing a fabric. In further aspects, the invention relates to a process for dyeing a fabric to produce a random dye pattern.

In further aspects, the process for dyeing a fabric comprises the steps of: immersing at least a portion of a fabric comprised of dyeable fibrous material in an aqueous liquid dyeing bath; adjusting the aqueous liquid dyeing bath to an elevated temperature greater than room temperature and below a boiling point of the aqueous dyeing bath; adjusting the pH of the aqueous liquid dying bath to an acidic level less than 7.0; after immersing at least a portion of the fabric into the aqueous liquid dyeing bath, introducing an amount of anionic dye into the aqueous liquid dyeing bath at a dye addition rate for a dye addition period to provide a dye solution, wherein the aqueous liquid dyeing bath is maintained at the elevated temperature and at the acidic level of pH for the dye addition period; and contacting the dyeable fibrous material with the dye solution for a dyeing period sufficient to dye at least a portion of the dyeable fibrous material.

As briefly described, the invention is useful for various types of fabrics. In aspects, the fabric is comprised of dyeable fibrous material. In further aspects, the dyeable fibrous material is formed from a material selected from natural materials, polymeric materials, or a combination thereof. In yet further aspects, the polymeric materials comprise polyesters, polyamides and polyolefins. In still further aspects, the polyesters are selected from the group consisting of poly(ethylene terephthalate), poly(butylene terephthalate) and copolymers and combinations thereof. In even further aspects, the polyolefins are selected from the group consisting of polypropylene, polypropylene derivatives, and copolymers and mixtures thereof. In yet further aspects, the fabric comprises a polyamide selected from the group consisting of nylon 6, nylon 6/6, nylon 6/9, nylon 6/10, nylon 6/12, nylon 11, nylon 12 and copolymers and combination thereof.

In further aspects, the disclosed processes exhibit utility in various fabrics and articles commonly manufactured from dyeable fiber material, and in particular, fibers formed from polymer compositions. In one aspect, these fibers can be employed in textile articles, including carpet. Thus, in one aspect, the invention relates to a carpet comprising fabric dyed using a disclosed method. In a further aspect, the invention relates to a carpet or carpet tile comprising a product of a disclosed process.

In various aspects, factors such as temperature, dye diffusion, and pH can alter the rate of dyeing and/or the total dye absorbed by the dyeable fibrous material of a fabric. In further aspects, the rate of dyeing the dyeable fibrous material is generally dependent on the rate of migration of dye in solution to the fiber surface, the rate of diffusion of dye at the fiber interface, and the rate of diffusion in the fiber matrix. In conventional dyeing methods, pre-incorporation and agitation of the dye in the dye bath effectively eliminates effects of dye diffusion to the fiber within a dye solution. Accordingly, the rate of dyeing in conventional methods is essentially dependent on the rate of dye movement within the fiber matrix. Moreover, in conventional dyeing methods, the pH of the dye bath is dropped at a rate which causes the dye to slowly diffuse into the fiber matrix. In this aspect, conventional dyeing methods control pH such that the dye becomes evenly distributed throughout the dye bath and fibers and is absorbed by the fibers uniformly to create a constant color and shade.

According to aspects of the present disclosure, the temperature of the aqueous liquid dyeing bath is adjusted at one or more stages during the dyeing process. In further aspects, the temperature can be increased, decreased, or held constant, or a combination thereof. In still further aspects, the temperature can be used to manipulate the rate of diffusion of the dye formulation. In some aspects, the aqueous liquid dyeing bath is adjusted to an elevated temperature greater than room temperature and below a boiling point of the aqueous dyeing bath. In further aspects, the elevated temperature is at least about 80° C. In still further aspects, the elevated temperature is less than or equal to about 100° C. For example, in yet further aspects, the elevated temperature is in a range of from about 80° C. to about 100° C., including exemplary temperatures of 81° C., 85° C., 88° C., 90° C., 93° C., 95° C., 97° C., 98° C., and 99° C. In still further aspects, the temperature can be within any range derived from any two of the above stated values.

In further aspects, the aqueous liquid dyeing bath can be adjusted at any desired rate. In still further aspects, rate can be increased, decreased, or held constant, or a combination thereof. In yet further aspects, temperature adjustment can be at a rate of from about 0.1° C./min. to about 30° C./min., including exemplary rates of from about 1.0° C./min. to about 10° C./min., from about 1.5° C./min. to about 5.0° C./min, from about 2.0° C./min. to about 4.5° C./min., from about 3.0° C./min. to about 4.0° C./min., In still further aspects, the rate of adjustment can be within any range derived from any two of the above stated values. For example, the rate of adjustment can be at least about 2.0° C./min., 5.0° C./min., 10° C./min., or 20° C./min.

In various aspects, the process comprises adjusting the aqueous liquid dyeing bath to an elevated temperature. In further aspects, the process comprises maintaining the temperature at an elevated temperature. In still further aspects, the elevated temperature can be maintained for any desired period. In yet further aspects, the aqueous liquid dyeing bath is maintained at the elevated temperature for a dyeing period. For example, the temperature of the aqueous liquid dyeing bath is maintained at the elevated temperature for a time sufficient to dye at least a portion of the dyeable fibrous material.

In further aspects, the aqueous liquid dyeing bath can be adjusted to the elevated temperature before, during, or after the addition of a component to the aqueous liquid dyeing bath. In still further aspects, a component can be added to the aqueous liquid dyeing bath before, during, or after the elevated temperature has been achieved. For example, in some aspects, at least a portion of the fabric is immersed into the aqueous liquid dyeing bath before the elevated temperature has been achieved. In other aspects, at least a portion of the fabric is immersed into the aqueous liquid dyeing bath after the elevated temperature has been achieved. In further aspects, at least a portion of the fabric is immersed into the aqueous liquid dyeing bath at the time when the elevated temperature is being achieved. In still further aspects, substantially all the fabric is immersed into the aqueous liquid dyeing bath.

In some aspects, at least one additive is introduced into the aqueous liquid dyeing bath before the elevated temperature has been achieved. In other aspects, at least one additive is introduced into the aqueous liquid dyeing bath after the elevated temperature has been achieved. In further aspects, at least one additive is introduced into the aqueous liquid dyeing bath at the time when the elevated temperature is being achieved.

In further aspects, at least a portion of the dye is introduced into the aqueous liquid dyeing bath before the elevated temperature has been reached. In still further aspects, at least a portion of the dye is introduced into the aqueous liquid dyeing bath after the target temperature has been achieved. In yet further aspects, at least a portion of the dye is introduced into the aqueous liquid dyeing bath at the time when the target temperature has been achieved.

According to various aspects, the process involves use of an aqueous liquid dyeing bath. In some aspects, the aqueous liquid dyeing bath comprises water. In other aspects, the aqueous liquid dyeing bath comprises water and is initially substantially free of a dye formulation. In further aspects, the aqueous liquid dyeing bath has an initial pH that inhibits dye saturation of the fabric. In still further aspects, the aqueous liquid dyeing bath has an initial pH that permits partial dye penetration of the fabric.

In further aspects, the aqueous liquid dyeing bath has an initial pH in the range of at greater than 7 to about 11, including further exemplary pH values of about 8, 9, and 10. In still further aspects, the initial pH can be within any range derived from any two of the above stated values. In some aspects, the aqueous liquid dyeing bath comprises at least one additive. In further aspects, examples of additives include, but are not limited to wetting agents, leveling agents, pH adjusting agents, light fastness enhancing agents, and water treatment agents. In some aspects, MYALON CCM is used to prevent fading from ozone agents in an amount of at least about 5.0 wt %, or 2.38 g/l based on a liquor ratio (ratio of lbs of fiber to lbs of water) of 21:1. In other aspects, PB-25 is used to prevent degradation is in an amount of at least about 3 wt % or 1.43 g/l at a liquor ration of 21:1.

In some aspects, the pH adjusting agent is present in the dye solution in an amount less than about 0.01 g/l. In other aspects, the pH adjusting agent is present in a range from about 0.01 g/l to about 10 g/l, including exemplary range of from about 0.1 g/l to about 1.5 g/l, or greater than 1.5 g/l, based on the volume of dye solution.

According to further aspects of the disclosure, the pH of the aqueous liquid dying bath is adjusted at one or more stages. In still further aspects, the pH can be increased, decreased, or held constant, or a combination thereof. In yet further aspects, the pH can be used to manipulate the strike rate of the dye formulation onto the fibers of the greige good. For example, according to some aspects, the pH is decreased to increase the strike rate of the dye formulation onto the fibers.

In various aspects, the pH of the aqueous liquid dying bath is adjusted to an acidic level less than about 7.0. In further aspects, the pH of the aqueous liquid dying bath is adjusted to a level sufficient to dye at least a portion of the dyeable fibrous material. For example, according to aspects of the disclosure, the pH of the aqueous liquid dying bath is adjusted to a range of from about 2 to about 7, including exemplary pH values of 3, 4, 5, and 6. In still further aspects, the pH can be within any range derived from any two of the above stated values. For example, according to aspects of the disclosure, the pH of the aqueous liquid dying bath can be adjusted to any acidic pH level, including exemplary pH values of about 1.0, 1.5, 2.0, 2.5, 3.0, 3.5, 4.0, 4.5, 5.0, 5.5, 6.0, or 6.5.

In further aspects, the pH of the aqueous liquid dying bath can be adjusted at any desired rate. In still further aspects, rate can be increased, decreased, or held constant, or a combination thereof. In yet further aspects, pH adjustment can be at any desired rate. For example, the pH adjustment rate can be from about 0.1/min. to about 10/min., including exemplary rates of from about 1.0/min. to about 5/min., from about 0.3/min. to about 0.9/min, In still further aspects, the rate of adjustment can be within any range derived from any two of the above stated values. For example, the rate of adjustment can be at least about 0.1/min., 1/min, or 3/min.

In various aspects, the methods comprise maintaining the pH of the aqueous liquid dying bath at an acidic pH level. In further aspects, the acidic pH can be maintained for any desired period. In still further aspects, the aqueous liquid dyeing bath is maintained at the acidic pH for a dyeing period. For example, the pH of the aqueous liquid dyeing bath is maintained at an acidic pH level for a time sufficient to dye at least a portion of the dyeable fibrous material.

In some aspects, at least one acid is added to the aqueous liquid dye bath to adjust the pH. In further aspects, the acid is added to the dye solution in an amount sufficient to adjust the pH of the aqueous liquid dye bath to an acidic level. In some aspects, the acid is and inorganic acid. In still further aspects, the acid comprises acetic acid, formic acid, sulfuric acid, phosphoric acid, citric acid, sulfamic, or a combination thereof. In yet further aspects, one or more acids can be used to obtain a desired pH. In even further aspects, at least one buffering salt is used for controlling pH.

In further aspects, the pH of the aqueous liquid dying bath can be adjusted before, during, or after the addition of a component to the aqueous liquid dying bath. In some aspects, at least one additive is introduced into the aqueous liquid dying bath before the acidic pH has been achieved. In other aspects, at least one additive is introduced into the aqueous liquid dying bath after the acidic pH has been achieved. In further aspects, at least one additive is introduced into the aqueous liquid dying bath at the time when the acidic pH is being achieved.

For example, in some aspects, at least a portion of the fabric is immersed into the aqueous liquid dyeing bath before the acidic pH level has been achieved. In other aspects, at least a portion of the fabric is immersed into the aqueous liquid dyeing bath after the acidic pH level has been achieved. In further aspects, at least a portion of the fabric is immersed into the aqueous liquid dyeing bath at the time when the acidic pH level is being achieved.

In further aspects, at least a portion of the anionic dye is introduced into the aqueous liquid dyeing bath before the acidic pH level has been achieved. In still further aspects, at least a portion of the anionic dye is introduced into the aqueous liquid dyeing bath after the acidic pH level has been achieved. In yet further aspects, at least a portion of the dye is introduced into the aqueous liquid dyeing bath at the time when the acidic pH is been achieved.

In various further aspects, the present methods involve introduction of a dye into the aqueous liquid dyeing bath to provide a dye solution. In further aspects, the dye comprises at least one anionic or acidic dye. In a still further aspect, the acid dye comprises at least one dye selected from a leveling acid dye, premetalized acid dye, or milling acid dye, or any combination thereof. In an even further aspect, the dye can comprise a dye formulation comprising at least one yellow dye, red dye, or blue dye, or any combination thereof.

In further aspects, the desired amount of dye can be into the aqueous liquid dyeing bath. In still further aspects, the amount of dye introduced comprises from about 0.01 g/l to about 3 g/l. In yet further aspects, the amount of dye is at least about 1.5 g/l.

Unlike conventional methods, the present methods utilize the effects of dye diffusion into the dye solution in conjunction with the rate of dye movement within the fiber matrix. In many aspects, the rate of dye passage across the fiber-liquid interface can be fast. Accordingly, in some aspects, after introduction of the dye, a portion of the dye immediately strikes onto the fiber, while a portion of the dye will diffuse in the aqueous liquid dyeing bath before striking onto the fiber. In further aspects, the random migration of the dye in the aqueous liquid dyeing bath can produce dye patterns having differing, random levels of dye depth of the dye color.

In various aspects, the manner of introduction of the dye formulation into the dye solution will affect the resulting dye pattern and depth. As will be appreciated by those of ordinary skill in the art, the anionic dye may be introduced in different forms and using different configurations. In one aspect, the anionic dye is introduced into the aqueous liquid dyeing bath at a dye addition rate for a dye addition period. In a further aspect, the dye addition rate is constant during the dye addition period. In a still further aspect, the dye addition rate varies during the dye addition period.

In other aspects, the anionic dye can be introduced into the aqueous liquid dyeing bath at any desired dye addition rate. In a further aspect, the anionic dye is introduced into the aqueous liquid dyeing bath at dye addition rate of at least about 0.2 g/1/min. In other aspects, the dye addition rate is in the range of from about 0.002 g/1/min to about 5 g/1/min, including exemplary values of 0.1, 0.5, 0.7, 0.9, 1.0, 1.5, 2.0, 5.2, 3.0, 4.0, and 4.5.

In another aspect, the anionic dye can be introduced into the aqueous liquid dyeing bath for any desired dye addition period. In a still further aspect, the anionic dye is introduced into the aqueous liquid dyeing bath for a dye addition period of at least about 1 minutes. In yet further aspects, the dye addition period is from about 1 minute to about 10 minutes, including exemplary values of 2, 3, 4, 5, 6, 7, 8, and 9 minutes.

In other aspects, the anionic dye can be introduced into the aqueous liquid dyeing bath is any desired form. In a further aspects, the anionic dye can be introduced into the aqueous liquid dyeing bath as a miscible liquid concentrate. As seen in the carpet tile installation of FIG. 4, the present methods can be used to produce an infinite number of dye patterns and appearances. For example, the dye can be introduced in a manner such that it produces a dye pattern that mimics the vein pattern of marble. For example, in an exemplary aspect, the disclosed process was used to produce the unique marbling pattern seen in FIG. 3. In other aspects, the dye formulation can be added such that it produces a dye pattern having variegated streaking. In further aspects, the dye formulation can be added such that it produces a tie dye pattern. In yet further aspect, the dye formulation can be added such that it produces a dye pattern that mimics lighting. In even further aspects, the dye formulation can be added such that it produces a dye pattern having a swirling pattern.

According to further aspects of the disclosure, the anionic dye can be introduced into the aqueous liquid dyeing bath in multiple stages. In further aspects, the dye is introduced as a first amount and a second amount. In still further aspects, the first amount of the dye is from 1% to 99% of a total dye amount and the second amount of the dye is from 99% to 1% of a total dye amount. In yet further aspects, the percentage of the total dye can be within any range derived from the above stated values. For example, the first amount of dye is 20% of a total dye amount and the second amount of the dye is 80% of a total dye amount, or the first amount of the dye is 40% of a total dye amount and the second amount of the dye is 60% of a total dye amount, or the first amount of the dye is 60% of a total dye amount and the second amount of the dye is 40% of a total dye amount. In this aspect, a portion of the anionic dye can be added into the aqueous liquid dyeing bath prior to adjusting the aqueous liquid dyeing bath to an elevated temperature or prior to adjusting the pH of the aqueous liquid dying bath to an acidic level, and the remaining portion of the anionic dye is added after adjusting the aqueous liquid dyeing bath to an elevated temperature or after adjusting the pH of the aqueous liquid dying bath to an acidic level pH. In some aspects, the initial introduction of the anionic dye can be used to produce a uniform base shade color and the subsequent introduction of the remaining anionic dye can be used to produce the unique dye pattern as described herein. For example, from 1% to about 99% of the anionic dye is added into the aqueous liquid dyeing bath prior to adjusting the aqueous liquid dyeing bath to an elevated temperature or prior to adjusting the pH of the aqueous liquid dying bath to an acidic level, and the remaining percentage of the anionic dye is added into the aqueous liquid dyeing bath after adjusting the aqueous liquid dyeing bath to an elevated temperature or after adjusting the pH of the aqueous liquid dying bath to an acidic level.

In various aspects, the disclosed process comprises contacting the dyeable fibrous material with the dye solution. In further aspects, the dyeable fibrous material is contacted with the dye solution for a dyeing period. In still further aspects, the dyeing period is for duration sufficient to dye at least a portion of the dyeable fibrous material. In still further aspects, the dyeing period can comprise any desired period.

For example, the dyeable fibrous material is contacted with the dye solution for a sufficient duration to produce a particular dye pattern. In yet further aspects, the dyeing period comprises a duration of at least 20 minutes. In yet further aspects, the duration of a given dyeing period will range from about 1 minute to about 120 minutes.

In further aspects, dyeable fibrous material can be contacted with the dye solution by any suitable means. In still further aspects, the dyeable fibrous material can be contacted with dye solution at any desired speed or configuration. In yet further aspects, the dyeable fibrous material is contacted with the dye solution before, during, or after introduction of the anionic dye into the aqueous liquid dyeing bath.

In further aspects, the fabric can be immersed in the aqueous liquid dyeing bath using any suitable method or apparatus. In some aspects, the fabric is placed at the bottom of the beck. In still further aspects, the fabric is immersed in the aqueous liquid dyeing bath by feeding or cycling the fabric through the aqueous liquid dyeing bath. In some aspects, the fabric is cycled through the aqueous liquid dyeing bath using a roller system. As one of skill in the art can appreciate, the roller or reel speed, or rate at which the fabric cycles on the roller, will also impact dye pattern and performance. For example, the fabric is in the form of an endless rope, or loop without ends, and the aqueous liquid dyeing bath is provided in an apparatus. In further aspects, the apparatus comprises a beck, sample beck, jet beck, jig beck, or rope dye machine. In other aspects, the method comprises a continuous application method or system.

In further aspects, the dyeable fibrous material can be contacted with the dye solution using any suitable method or apparatus. In still further aspects, the dyeable fibrous material is contacted with the dye solution by feeding or cycling the greige good through the dye solution. In some aspects, the dyeable fibrous material is cycled through the dye solution using a roller system. For example, the dyeable fibrous material is in a form of an endless rope, and the dye solution is provided in an apparatus. In further aspects, the apparatus comprises a beck, sample beck, jet beck, jig beck, or rope dye machine. In other aspects, the method comprises a continuous application method or system.

According to further aspects, the process can comprise multiple dyeing periods. In still further aspects, the subsequent dyeing periods can comprise a first dye solution or a second dye solution. For example, the process can optionally further comprise immersing at least a portion of a fabric comprised of dyeable fibrous material in an aqueous liquid dyeing bath; after immersing at least a portion of the fabric into the aqueous liquid dyeing bath, introducing a first amount of anionic dye into the aqueous liquid dyeing bath at a first dye addition rate for a first dye addition period to provide a first dye solution; contacting the dyeable fibrous material with the first dye solution for a first dyeing period sufficient to dye at least a first portion of the dyeable fibrous material; adjusting the pH of the aqueous liquid dying bath after the first dyeing period to an acidic level less than 7.0; after adjusting the pH of the aqueous liquid dying bath, introducing a second amount of an anionic dye into the aqueous liquid dyeing bath at a second dye addition rate for a second dye addition period to provide a second dye solution, wherein the aqueous liquid dyeing bath is maintained at the elevated temperature and at the acidic level of pH for the dye addition period; and contacting the dyeable fibrous material with the dye solution for a second dyeing period sufficient to dye at least a second portion of the dyeable fibrous material. In further aspects, the first amount of the dye is from 1% to 99% of a total dye amount and the second amount of the dye is from 99% to 1% of a total dye amount. In yet further aspects, the percentage of the total dye can be within any range derived from the above stated values. For example, the first amount of dye is 20% of a total dye amount and the second amount of the dye is 80% of a total dye amount, or the first amount of the dye is 40% of a total dye amount and the second amount of the dye is 60% of a total dye amount, or the first amount of the dye is 60% of a total dye amount and the second amount of the dye is 40% of a total dye amount.

In a further aspect, the fiber is immersed in the aqueous dyeing bath for a minimum of 5 to about 20 minutes. In some aspects, the addition of the 1st dye amount or original dye, for example, for the base shade, is about 5 min. In further aspects, after the elevated temperature has been achieved, this dyeing period is in a range from about 10 minutes for levelness to about 75 min. The second dye addition (or contrast dye) period is at least about 1 minute to about 30 minutes. In further aspect, any of the disclosed period can have a hold period, lasting from about 1 min to about 30 minutes, for example 10 minutes.

In various aspects, the process comprises at least one finishing or processing step. In further aspects, the fabric is rinsed after contacting the dye solution. In still further aspects, fabric is rinsed after application of at least one auxiliary chemical. In some aspects, the fabric is rinsed with water. In other aspects, the fabric is rinsed with water and at least one disclosed additive.

In various further aspects, the methods also comprise drying the fabric. In still further aspects, drying of the fabric can comprise using any suitable drying method or device. In some aspects, the fabric is allowed to dry in the dyeing machine. In other aspects, the fabric is dried in an oven or drying device. In further aspects, the fabric can be dried at any desired temperature. In some aspects, the fabric is dried at room temperature. In other aspects, the fabric is dried at a temperature in the range of from about 30° F. to about 320° F., including exemplary ranges of from about 50° F. to about 300° F., from about 75° F. to about 250° F., and from about 125° F. to about 200° F. In still further aspects, the temperature can be within any range derived from any two of the above stated values.

In further aspects, the fabric can finished to produce a carpet. In still further aspects, the fabric can be finished using any desired method or material. In yet further aspects, the finishing step can comprise application of at least one backing layer, for example, a secondary backing layer, padding layer, reinforcement layer, or foam layer, or any combination thereof.

Figure 2:
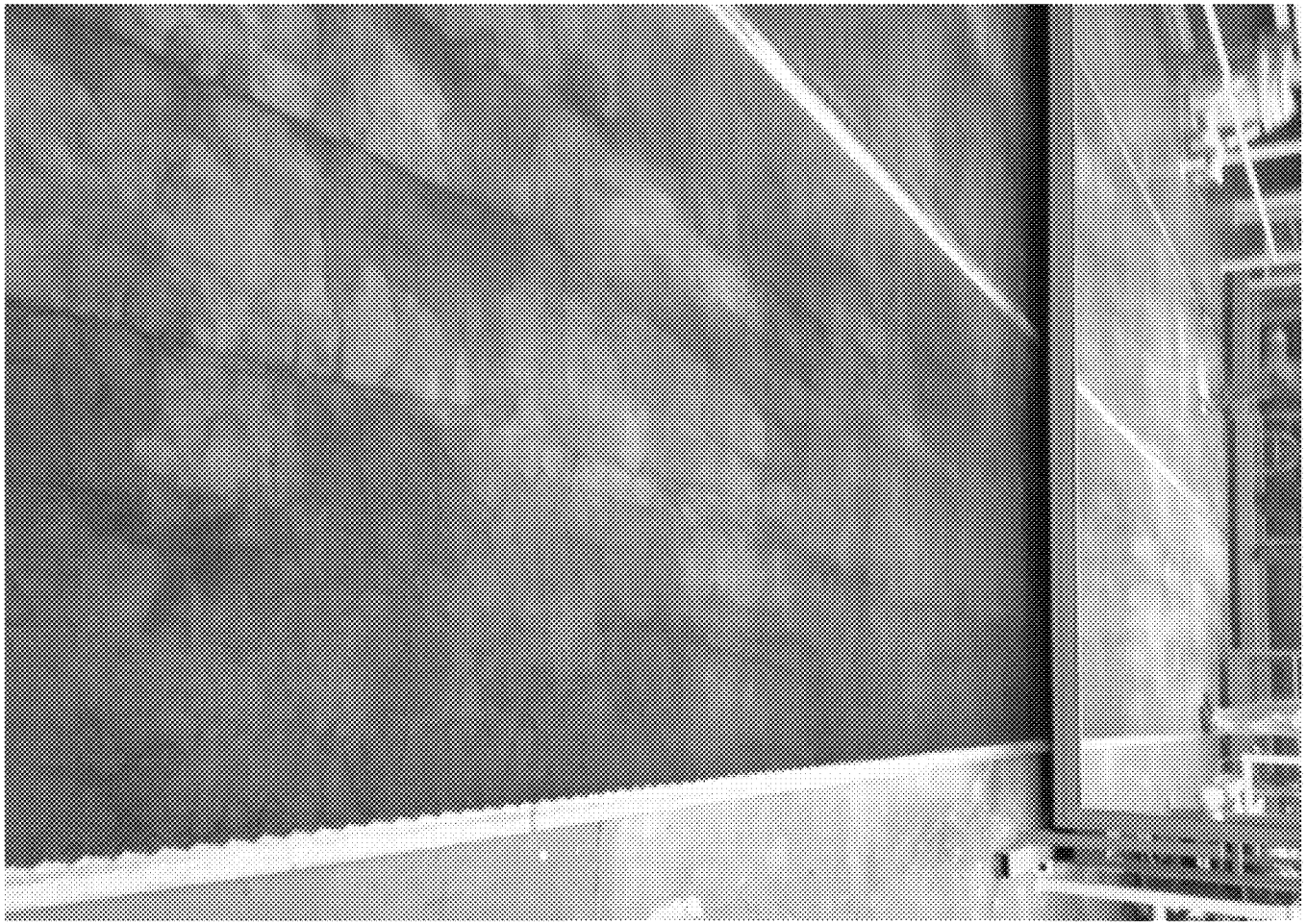
FIG. 2 is a picture of representative carpet tiles produced in accordance with methods of the present invention.
Figure 3:
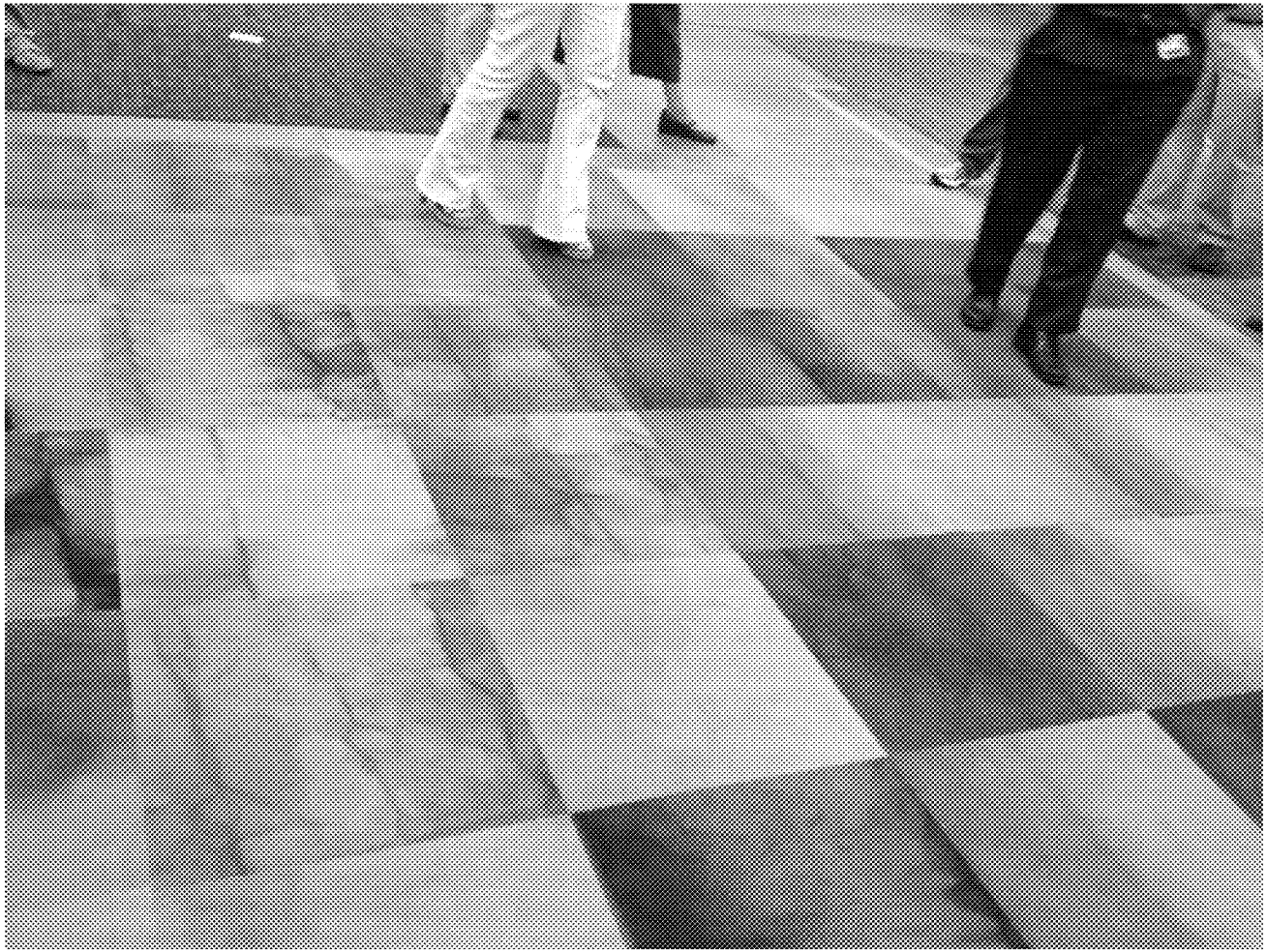
FIG. 3 is a picture of representative carpet rolls produced in accordance with methods of the present invention.
Figure 4:
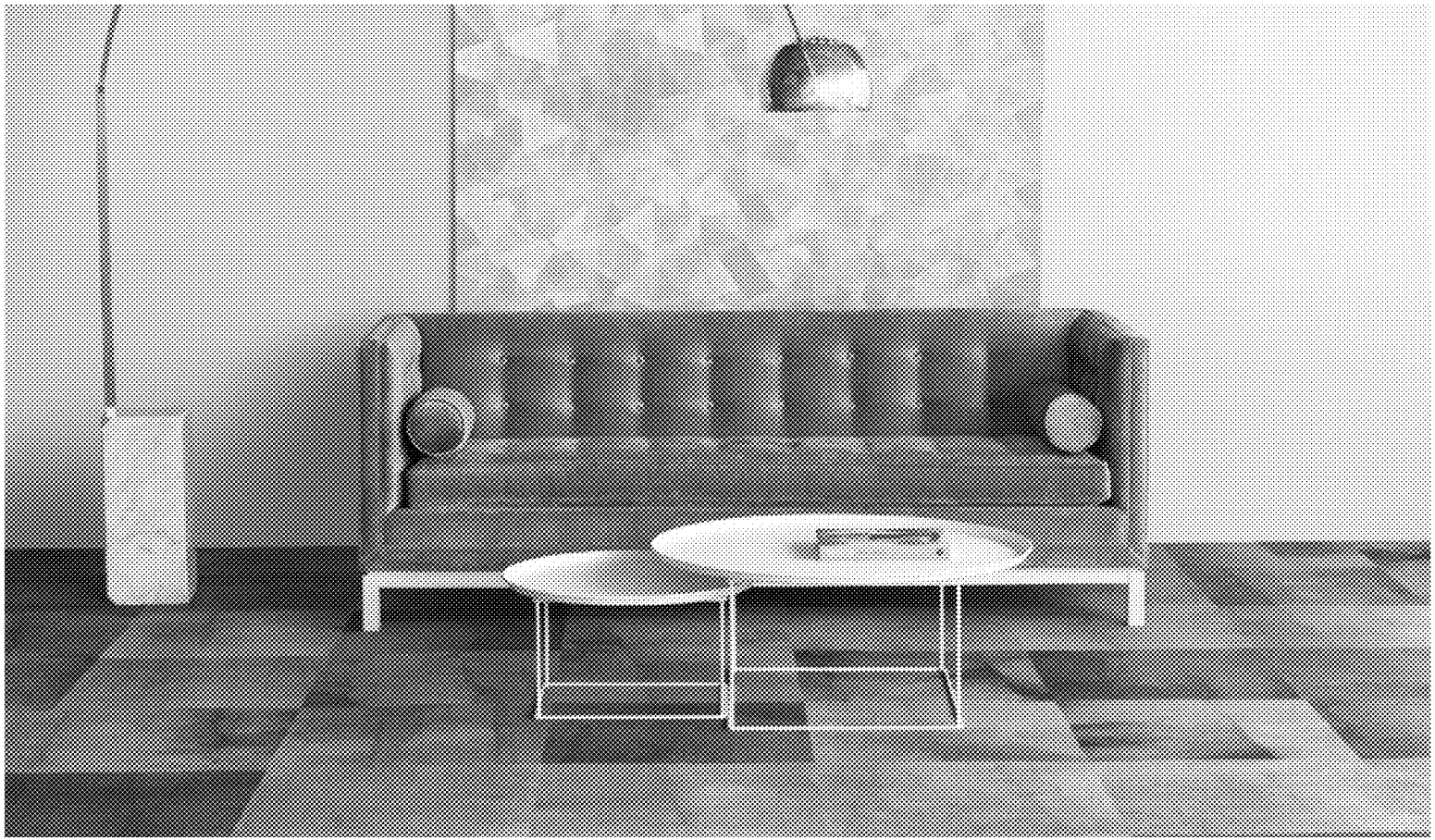
FIG. 4 is a picture of a finished installation using carpet tiles produced in accordance with methods of the present invention.

In further aspects, the processing step comprises cutting the finished carpet into any desired size. In some aspects, the finished carpet can be cut to a width of about 6 inches to about 12 feet, as shown in FIG. 2. As shown in FIG. 3, the finished carpet can also be cut into a plurality of carpet tiles. In further aspects, the carpet tiles can cut into any desired shape or size. For example, the carpet tile can be square or rectangular. In a further example, the carpet tile can be from 12 inches to 96 inches in width, and from 12 inches to 96 inches in length.

As described herein, the disclosed process is useful for producing unique dye patterns. According to aspects, the disclosed dyeing processes produce amorphous dye patterns. In further aspects, the dyeing processes produce non-repeatable, dye patterns. In still further aspects, the processes produce patterns having a visual effect of blending of multiple sequential shades of a given anionic dye formulation. For example, according to aspects of the disclosure, the dyeing process can produce the visual effect of a dye pattern having at least 3 shade variants of an anionic dye formulation. In a further aspect, the dye pattern can have at least 5 shade variants of an anionic dye formulation. In a still further aspect, the dye pattern can have at least 10 shade variants of an anionic dye formulation. In a still further aspect, the dye pattern can have at least 15 shade variants of an anionic dye formulation.

In further aspects, the unique dye patterns produced using the current methods can be used as templates for dyeing a fabric. For example, if a particular dye pattern is desired to be reproduced, the process for dyeing the fabric would comprise the steps of: a) obtaining an image of a dye pattern produced by a disclosed method; b) identifying at least one color shade in the pattern as a reference color; and c) using the image to print the dye pattern on a greige good. In further aspect, multiple dye formulations can be produced based on the reference color to provide a shade gradient comprising shade variants of the reference color. In still further aspects, the dye pattern can be printed on the greige good using any suitable print dyeing method. Examples of suitable print dyeing methods include jet printing, chromo jet, screen print, rotary print, and color flow printing.

The disclosed methods and compositions can further comprise one or more additives known to those of skill in the art, such as optical brighteners, different dye classes, copolymers, and any type of additive that provides an additional benefit with the proviso that it does not interfere with the properties necessary for the invention to operate. That is, one of skill can readily modify one or more properties of the disclosed compositions by selection and inclusion of one or more additives. As further examples, the one or more additives can be selected from lubricants, nucleating agents, antioxidants, ultraviolet light stabilizers, antistatic agents, soil resists agents, stain resists agents, antimicrobial agents, flame retardants and combinations thereof.

In a further aspect, as will be appreciated by those of ordinary skill in the art, the various steps and process conditions of the disclosed methods can be monitored or automated. In still further aspects, the dyeing process conditions can be monitored and adjusted as necessary to achieve a desired parameter. For example, the pH value or temperature can be monitored in real-time and process conditions adjusted in real-time. In yet further aspects, one or more pH adjusting agents can be automatically added to maintain a desired pH. Likewise, the temperature may be controlled in real-time to maintain a desired temperature.

It is understood that the disclosed processes can be employed in connection with the disclosed fibers, compositions, mixtures, and uses.

In various aspects, the present invention pertains to and includes at least the following aspects.

Aspect 1: A process for dyeing a fabric, comprising the steps of: a) immersing at least a portion of a fabric comprised of dyeable fibrous material in an aqueous liquid dyeing bath; b) adjusting the aqueous liquid dyeing bath to an elevated temperature greater than room temperature and below a boiling point of the aqueous dyeing bath; c) adjusting the pH of the aqueous liquid dying bath to an acidic level less than 7.0; d) after immersing at least a portion of the fabric into the aqueous liquid dyeing bath, introducing an amount of anionic dye into the aqueous liquid dyeing bath at a dye addition rate for a dye addition period to provide a dye solution, wherein the aqueous liquid dyeing bath is maintained at the elevated temperature and at the acidic level of pH for the dye addition period; and e) contacting the dyeable fibrous material with the dye solution for a dyeing period sufficient to dye at least a portion of the dyeable fibrous material.

Aspect 2: the process of aspect 1, wherein the aqueous liquid dyeing bath is adjusted to the elevated temperature and the acidic pH before immersing at least a portion of the fabric.

Aspect 3: The process of aspect 1 or 2, wherein the aqueous liquid dyeing bath is adjusted to the elevated temperature after immersing at least a portion of the fabric.

Aspect 4: The process of any of aspects 1-3, wherein the aqueous liquid dying bath is adjusted to the acidic pH after immersing at least a portion of the fabric.

Aspect 5: The process of any of aspects 1-4, wherein the elevated temperature is greater than 80° C.

Aspect 6: The process any of aspects 1-5, wherein the elevated temperature is less than 100° C.

Aspect 7: The process of any of aspects 1-6, wherein the acidic pH is less than 6.0

Aspect 8: The process of any of aspects 1-7, wherein the acidic pH is less than 5.0

Aspect 9: The process of any of aspects 1-8, wherein the acidic pH is less than 4.0

Aspect 10: The process of any of aspects 1-9, wherein the fabric is a greige good.

Aspect 11: The process of any of aspects 1-10, wherein the dyeable fibrous material comprises a polyamide.

Aspect 12: The process of any of aspects 1-11, wherein the dyeable fibrous material comprises a nylon 6 or nylon 6,6.

Aspect 13: The process of any of aspects 1-12, wherein the aqueous liquid dyeing bath is maintained at the elevated temperature and at the acidic level of pH for the dyeing period.

Aspect 14: The process of any of aspects 1-13, wherein the anionic dye is introduced into the aqueous liquid dyeing bath as a miscible liquid concentrate.

Aspect 15: The process of any of aspects 1-14, comprising: a) immersing at least a portion of a fabric comprised of dyeable fibrous material in an aqueous liquid dyeing bath; b) after immersing at least a portion of the fabric into the aqueous liquid dyeing bath, introducing a first amount of anionic dye into the aqueous liquid dyeing bath at a first dye addition rate for a first dye addition period to provide a first dye solution; c) contacting the dyeable fibrous material with the first dye solution for a first dyeing period sufficient to dye at least a first portion of the dyeable fibrous material; d) adjusting the pH of the aqueous liquid dying bath after the first dyeing period to an acidic level less than 7.0; e) after adjusting the pH of the aqueous liquid dying bath, introducing a second amount of an anionic dye into the aqueous liquid dyeing bath at a second dye addition rate for a second dye addition period to provide a second dye solution, wherein the aqueous liquid dyeing bath is maintained at the elevated temperature and at the acidic level of pH for the dye addition period; and f) contacting the dyeable fibrous material with the dye solution for a second dyeing period sufficient to dye at least a second portion of the dyeable fibrous material.

Aspect 16: The process of any of aspects 1-15, wherein the first amount of an anionic dye is from 1% to 99% of a total dye amount and the second amount of the anionic dye is from 99% to 1% of a total dye amount.

Aspect 17: The method of any of aspects 1-16, wherein the first amount of an anionic dye is 20% of a total dye amount and the second amount of the anionic dye is 80% of a total dye amount.

Aspect 18: The method of any of aspects 1-17, wherein the first amount of an anionic dye is 40% of a total dye amount and the second amount of the anionic dye is 60% of a total dye amount.

Aspect 19: The method of any of aspects 1-18, wherein the first amount of an anionic dye is 60% of a total dye amount and the second amount of the anionic dye is 40% of a total dye amount.

Aspect 20: The process of any of aspects 1-19, wherein the fabric is a greige good in the form of an endless loop and the aqueous liquid dyeing bath is provided in a beck dyer.

Aspect 21: A fabric dyed according to the process of any of aspects 1-20.

Aspect 22: The process of any of aspects 1-21, wherein the aqueous dye solution comprises one or more additives.

Aspect 23: The process of any of aspects 1-22, wherein the additives are selected from a wetting agent, a leveling agent, a pH adjusting agent, a light fastness enhancing agent and a water treatment agent.

Aspect 24: The process of any of aspects 1-23, wherein the aqueous liquid dyeing bath has a pH prior to adjusting that inhibits full dye saturation of the greige good.

Aspect 25: The process of any of aspects 1-24, wherein the aqueous liquid dyeing bath has a pH prior to adjusting in the range of at least about 7 to about 11.

Aspect 26: The method of any of aspects 1-25, wherein contacting comprises feeding the greige good through the aqueous liquid dye solution.

Aspect 27: The process of any of aspects 1-26, wherein the process produces a random dye pattern.

Aspect 28 The process of any of aspects 1-27, wherein the process produces a non-repeatable dye pattern.

Aspect 29: The process of any of aspects 1-28, wherein the process produces variable dye shading.

Aspect 30: The process of any of aspects 1-29, wherein the process produces a pattern having a visual effect of blending of multiple sequential shades of the dye formulation.

Aspect 31: The process of any of aspects 1-30, wherein the process produces a dye pattern having at least 3 shade variants of the dye formulation.

Aspect 32: The process of any of aspects 1-31, wherein the process produces a dye pattern having at least 5 shade variants of the dye formulation.

Aspect 33: The process of any of aspects 1-32, wherein the process produces a dye pattern having at least 10 shade variants of the dye formulation.

Aspect 34: The process of any of aspects 1-33, wherein the process produces a dye pattern having at least 15 shade variants of the dye formulation.

Aspect 35: The process of any of aspects 1-34, wherein the process produces a marbling dye pattern.

Aspect 36: The process of any of aspects 1-35, wherein the fabric comprises at least one additive selected from lubricants, nucleating agents, antioxidants, ultraviolet light stabilizers, antistatic agents, soil resists agents, stain resists agents, antimicrobial agents, flame retardants and combinations thereof.

Aspect 37: The process of any of aspects 1-36, wherein the dye addition rate is constant during the dye addition period.

Aspect 38: The process of any of aspects 1-37, wherein the dye addition rate varies during the dye addition period.

Aspect 39: The process of any of aspects 1-38, wherein the initial portion of the dye is used to produce a uniform base shade color and the remaining portion of the dye is used to produce a contrasting dye pattern.

Aspect 40: The process of any of aspects 1-39, wherein the fabric is formed from a material selected from natural materials, polymeric materials, and combinations thereof.

Aspect 41: The process of any of aspects 1-40, wherein the polymeric materials are selected from the group consisting of polyamides and polyolefins.

Aspect 42: The process of any of aspects 1-41, wherein the polyamides are selected from the group consisting of nylon 6, nylon 6/6, nylon 6/9, nylon 6/10, nylon 6/12, nylon 11, nylon 12 and copolymers and combination thereof.

Aspect 43: The process of aspect 1-42, further comprising the steps of: a) cooling the temperature of the aqueous liquid dyeing bath after the dyeing period; b) drying the fabric; and c) finishing the fabric.

Aspect 44: The process of any of aspects 1-43, wherein finishing comprises application of at least one backing layer.

Aspect 45: The process of any of aspects 43, wherein finishing comprises sizing the fabric.

Aspect 46: A process for dyeing a fabric comprising the steps of: a) obtaining an image of a dye pattern produced by the process of aspect 1; b) identifying at least one color shade in the pattern as a reference color; c) producing at least one dye formulation based on the reference color; and d) using the image to print a dye pattern on a greige good.

C. Experimental

The following examples are put forth so as to provide those of ordinary skill in the art with a complete disclosure and description of how the compounds, compositions, articles, devices and/or methods claimed herein are made and evaluated, and are intended to be purely exemplary of the invention and are not intended to limit the scope of what the inventors regard as their invention. Efforts have been made to ensure accuracy with respect to numbers (e.g., amounts, temperature, etc.), but some errors and deviations should be accounted for. Unless indicated otherwise, parts are parts by weight, temperature is in ° F. or is at ambient temperature, and pressure is at or near atmospheric.

1. Beck Dyeing Methodology

Different dyeing trials were conducted using various sizes of fabrics. After selecting the desired size and fiber type, the fabric was placed in a beck dyeing machine, and an aqueous liquid dyeing bath was added to obtain the correct liquor ratio. Briefly, the temperature of the dye solution was increased to the elevated temperature and the pH of dye solution decreased as described herein. Next, an anionic dye formulation was introduced into the aqueous liquid dyeing bath to provide a dye solution. In some embodiments, a portion of the dye was added to the dye solution prior to adjustment of the temperature and pH as described herein. After contacting the fabric with the dye solution for the dyeing period to produce a dye pattern, the fabric was finished as described herein. For example, finishing the fabric included one or more steps selected from cooling the dye solution, rinsing the greige good, drying the greige good, application of at least one backing layer, and cutting the dyed product into carpet tiles.

a. Beck Dyeing Example 1

In Example 1, greige good rolls of 6'×375' were selected and loaded into a beck dyeing machine. After being contacted in an aqueous dye solution as described above, the dye was measured and added to the aqueous dye solution as described herein. The rolls were finished and cut into carpet tiles as described herein. As illustrated by the carpet tiles in FIG. 1, this dyeing method produced a good overall consistency with a marbling pattern.

b. Beck Dyeing Example 2

In Example 2, a 6'×400' greige good roll of Scepter II 42 oz having a weight of 1503 lbs was selected and loaded into a beck dyeing machine. In this example, the pH of the aqueous dyeing bath was reduced prior to reaching the elevated temperature. Additionally, the acid dosing rate was increased such that the acidic pH level was reached at a quicker rate. The dye addition period was 6 minutes, and dyeing was performed at pH of 3.5.

The results using these parameters produced improved overall consistency, good marbling throughout the roll, and no light areas.

c. Beck Dyeing Example 3

In Example 3, two 6'×470' greige rolls, each having roll weights of 1657 lb. were selected and loaded into the beck dyeing machine. This trial employed two dyeing periods. The first dyeing period comprised a base shading period using 60% of the dye, and a second dyeing period comprised the contrast dyeing period using the remaining 40% of the dye formulation. The base shade dye addition period was 20 minutes. For the contrast dyeing period, the dye addition period was 12 minutes into a dye solution having a pH of 3.65. The contrast dyeing period was 21 minutes, yielding a ratio of 12.5 rounds per drop. Total seam to seam time was 1 minute and 40 seconds.

This trial produced good distribution of color, with marbled pattern throughout the roll.

d. Beck Dyeing Example 4

In Example 4, two 6'×235' greige rolls were selected, and loaded into the beck dyeing machine. In this example, shorter rolls were used in an effort to minimize the time the carpet sits stationary in the bottom of the beck.

In this example, the total hold time in the beck was 50 minutes, the entire cycle time was 70 min, using a liquor ratio of 21:1. The total time the roll was in the beck was approximately 2 hours. The dye addition duration for the contrast dye was 6 min, at a pH of 3.2. Seam to seam cycle time was 40 seconds. This trial produced faint marbling, some light areas, and some near solid areas.

e. Beck Dyeing Example 5

In Example 5, once pH of 3.2 was acquired, beck held at steady state for 15 min before contrast dye was dropped. Seam to seam cycle time 1 min. Dye tank valve opened 100%, yielding a dye addition duration of 4 min 52 sec. The contrast dyeing period was 10 min. This trial produced good color distribution and variation throughout, as well as good marbling effect.

f. Beck Dyeing Example 6

In Example 6, 2 rolls, 235' ea., roll wt 824 lb. Contrast dye addition period was 5 min, at pH 3.2, and 205 F. Reel speed during the contrast dyeing period was 235, seam to seam time 1 min, liquor ratio 2000 gal 22:1 (lbs water to carpet). Total time in beck was 1 hr 45 min. This trial produce good color contrast and marbling.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A process for dyeing a fabric, comprising the steps of:

a. immersing at least a portion of a fabric in an aqueous liquid dyeing bath, wherein the fabric is a greige good comprising dyeable fibrous material;

b. adjusting the aqueous liquid dyeing bath to an elevated temperature greater than room temperature and below a boiling point of the aqueous dyeing bath;

c. adjusting the pH of the aqueous liquid dyeing bath to an acidic level less than 7.0;

d. after immersing at least a portion of the fabric into the aqueous liquid dyeing bath, introducing an amount of anionic dye into the aqueous liquid dyeing bath at a dye addition rate for a dye addition period to provide a dye solution, wherein the aqueous liquid dyeing bath is maintained at the elevated temperature and at the acidic level of pH for the dye addition period; and e. contacting the dyeable fibrous material with the dye solution for a dyeing period sufficient to dye at least a portion of the dyeable fibrous material;

wherein the process provides on the fabric at least one of a random dye pattern, a non-repeatable pattern, and a variable dye shading.

2. The process of claim 1, wherein the aqueous liquid dyeing bath is adjusted to the elevated temperature and the acidic pH before immersing at least a portion of the fabric.

3. The process of claim 1, wherein the aqueous liquid dyeing bath is adjusted to the elevated temperature after immersing at least a portion of the fabric.

4. The process of claim 1, wherein the aqueous liquid dyeing bath is adjusted to the acidic pH after immersing at least a portion of the fabric.

5. The process of claim 1, wherein the elevated temperature is greater than 80° C.

6. The process of claim 1, wherein the elevated temperature is less than 100° C.

7. The process of claim 1, wherein the acidic pH is less than 6.0.

8. The process of claim 1, wherein the acidic pH is less than 5.0.

9. The process of claim 1, wherein the acidic pH is less than 4.0.

10. The process of claim 1, wherein the dyeable fibrous material comprises a polyamide.

11. The process of claim 10, wherein the dyeable fibrous material comprises a nylon 6 or nylon 6,6.

12. The process of claim 1, wherein the aqueous liquid dyeing bath is maintained at the elevated temperature and at the acidic level of pH for the dyeing period.

13. The process of claim 1, wherein the anionic dye is introduced into the aqueous liquid dyeing bath as a miscible liquid concentrate.

14. The process of claim 1, comprising:

a. immersing at least a portion of the fabric comprised of dyeable fibrous material in an aqueous liquid dyeing bath;

b. after immersing at least a portion of the fabric into the aqueous liquid dyeing bath, introducing a first amount of anionic dye into the aqueous liquid dyeing bath at a first dye addition rate for a first dye addition period to provide a first dye solution;

c. contacting the dyeable fibrous material with the first dye solution for a first dyeing period sufficient to dye at least a first portion of the dyeable fibrous material;

d. adjusting the pH of the aqueous liquid dyeing bath after the first dyeing period to an acidic level less than 7.0;

e. after adjusting the pH of the aqueous liquid dyeing bath, introducing a second amount of an anionic dye into the aqueous liquid dyeing bath at a second dye addition rate for a second dye addition period to provide a second dye solution, wherein the aqueous liquid dyeing bath is maintained at the elevated temperature and at the acidic level of pH for the dye addition period; and f. contacting the dyeable fibrous material with the dye solution for a second dyeing period sufficient to dye at least a second portion of the dyeable fibrous material.

15. The process of claim 14, wherein the first amount of an anionic dye is from 1% to 99% of a total dye amount and the second amount of the anionic dye is from 99% to 1% of a total dye amount.

16. The method of claim 14, wherein the first amount of an anionic dye is 20% of a total dye amount and the second amount of the anionic dye is 80% of a total dye amount.

17. The method of claim 14, wherein the first amount of an anionic dye is 40% of a total dye amount and the second amount of the anionic dye is 60% of a total dye amount.

18. The method of claim 14, wherein the first amount of an anionic dye is 60% of a total dye amount and the second amount of the anionic dye is 40% of a total dye amount.

19. The process of claim 1, wherein the fabric is a greige good in the form of an endless loop and the aqueous liquid dyeing bath is provided in a beck dyer.

20. The process of claim 1, wherein the aqueous dye solution comprises one or more additives.

21. The process of claim 20, wherein the additives are selected from a wetting agent, a leveling agent, a pH adjusting agent, a light fastness enhancing agent and a water treatment agent.

22. The process of claim 1, wherein the aqueous liquid dyeing bath has a pH prior to adjusting that inhibits full dye saturation of the fabric.

23. The process of claim 1, wherein the aqueous liquid dyeing bath has a pH prior to adjusting in the range of at least about 7 to about 11.

24. The method of claim 1, wherein contacting comprises feeding the fabric through the aqueous liquid dye solution.

25. The process of claim 1, wherein the process produces a random dye pattern.

26. The process of claim 1, wherein the process produces a non-repeatable dye pattern.

27. The process of claim 1, wherein the process produces variable dye shading.

28. The process of claim 1, wherein the process produces a pattern having a visual effect of blending of multiple sequential shades of the dye formulation.

29. The process of claim 1, wherein the process produces a dye pattern having at least 3 shade variants of the dye formulation.

30. The process of claim 1, wherein the process produces a dye pattern having at least 5 shade variants of the dye formulation.

31. The process of claim 1, wherein the process produces a dye pattern having at least 10 shade variants of the dye formulation.

32. The process of claim 1, wherein the process produces a dye pattern having at least 15 shade variants of the dye formulation.

33. The process of claim 1, wherein the process produces a marbling dye pattern.

34. The process of claim 1, wherein the fabric comprises at least one additive selected from lubricants, nucleating agents, antioxidants, ultraviolet light stabilizers, antistatic agents, soil resists agents, stain resists agents, antimicrobial agents, flame retardants and combinations thereof.

35. The process of claim 1, wherein the dye addition rate is constant during the dye addition period.

36. The process of claim 1, wherein the dye addition rate varies during the dye addition period.

37. The process of claim 1, wherein the initial portion of the dye is used to produce a uniform base shade color and the remaining portion of the dye is used to produce a contrasting dye pattern.

38. The process of claim 1, wherein the fabric is formed from a material selected from natural materials, polymeric materials, and combinations thereof.

39. The process of claim 38, wherein the polymeric materials are selected from the group consisting of polyamides and polyolefins.

40. The process of claim 39, wherein the polyamides are selected from the group consisting of nylon 6, nylon 6/6, nylon 6/9, nylon 6/10, nylon 6/12, nylon 11, nylon 12 and copolymers and combination thereof.

41. The process of claim 1, further comprising the steps of:

a. cooling the temperature of the aqueous liquid dyeing bath after the dyeing period;

b. drying the fabric; and c. finishing the fabric.

42. The process of claim 41, wherein finishing comprises application of at least one backing layer.

43. The process of claim 41, wherein finishing comprises sizing the fabric.

* * * * *